US010390167B2

(12) United States Patent
Kaneko

(10) Patent No.: US 10,390,167 B2
(45) Date of Patent: Aug. 20, 2019

(54) EAR SHAPE ANALYSIS DEVICE AND EAR SHAPE ANALYSIS METHOD

(71) Applicant: Yamaha Corporation, Hamamatsu-shi, Shizuoka-Ken (JP)

(72) Inventor: Shoken Kaneko, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/920,185

(22) Filed: Mar. 13, 2018

(65) Prior Publication Data

US 2018/0206056 A1 Jul. 19, 2018

Related U.S. Application Data

(63) Continuation of application No. PCT/JP2016/053661, filed on Feb. 8, 2016.

(30) Foreign Application Priority Data

Sep. 14, 2015 (JP) ..... 2015-180994

(51) Int. Cl.
*H04S 7/00* (2006.01)
*G10K 15/00* (2006.01)
(Continued)

(52) U.S. Cl.
CPC ..... *H04S 7/303* (2013.01); *G10K 15/00* (2013.01); *H04S 1/00* (2013.01); *H04S 5/02* (2013.01); *H04S 2420/01* (2013.01)

(58) Field of Classification Search
None
See application file for complete search history.

(56) References Cited

U.S. PATENT DOCUMENTS 6,795,556 B1 * 9/2004 Sibbald ..... H04S 1/002 381/1
8,032,337 B2 * 10/2011 Deichmann ..... A61F 11/08 345/419

(Continued)

FOREIGN PATENT DOCUMENTS

JP 2013-524711 A 6/2013
JP 2015-19360 A 1/2015
WO WO 2005/025270 A1 3/2005

OTHER PUBLICATIONS

Burkhard et al, "Anthropometric manikin for acoustic research." pp. 1-10. Jul. 1975.*

(Continued)

*Primary Examiner* — Qin Zhu
(74) *Attorney, Agent, or Firm* — Crowell & Moring LLP

(57) ABSTRACT

An ear shape analyzer includes: a sample ear analyzer configured to generate, for each of N sample ears, an ear shape data set that represents a difference between a point group representative of a three-dimensional shape of a reference ear and a point group representative of a three-dimensional shape of one of the N sample ears; an averaging calculator configured to generate averaged shape data by averaging N ear shape data sets generated by the sample ear analyzer; an ear shape identifier configured to identify an average ear shape of the N sample ears by translating coordinates of respective points of the point group representing the three-dimensional shape of the reference ear, by using the averaged shape data.

14 Claims, 10 Drawing Sheets

(51) Int. Cl.
*H04S 1/00* (2006.01)
*H04S 5/02* (2006.01)

(56) References Cited

U.S. PATENT DOCUMENTS

| | | | | |
|---|---|---|---|---|
| 2006/0274901 | A1 | 12/2006 | Terai et al. | |
| 2008/0306720 | A1* | 12/2008 | Nicol | H04S 7/30 703/13 |
| 2010/0100362 | A1* | 4/2010 | Zouhar | G06F 17/50 703/2 |
| 2010/0296664 | A1* | 11/2010 | Burgett | A61F 11/08 381/67 |
| 2013/0046790 | A1 | 2/2013 | Katz et al. | |
| 2015/0010160 | A1 | 1/2015 | Udesen | |
| 2015/0073262 | A1* | 3/2015 | Roth | A61B 5/1077 600/411 |
| 2016/0142848 | A1* | 5/2016 | Saltwell | H04S 5/00 381/17 |

OTHER PUBLICATIONS

International Search Report (PCT/ISA/210) issued in PCT Application No. PCT/JP2016/053661 dated Mar. 8, 2016 with English translation (four pages).

Japanese-language Written Opinion (PCT/ISA/237) issued in PCT Application No. PCT/JP2016/053661 dated Mar. 8, 2016 (four pages).

Xu et al., "Individualization of Head-Related Transfer Function for Three-Dimensional Virtual Auditory Display: A Review", Virtual Reality, 2007, pp. 397-407, Springer-Verlag Berlin Heidelberg.

Dellepiane et al., "Recondstructing head models from photographs for individualized 3D-audio processing", Computer Graphics Forum, 2008, pp. 1719-1727 (10 pages total), vol. 27, No. 7, Blackwell Publishing Ltd.

Chui et al., "A new point matching algorithm for non-rigid registration", Computer Vision and Image Understanding, Academic Press, 2003, pp. 114-141, Elsevier Science.

Jian et al., "Robust Point Set Registration Using Gaussian Mixture Models", IEEE Transactions on Pattern Analysis and Machine Intelligence, Aug. 2011, pp. 1633-1645, vol. 33, No. 8.

Katz, "Boundary element method calculation of individual head-related transfer function. I. Rigid model calculation", The Journal of the Acoustical Society of America, Nov. 2001, pp. 2440-2448, vol. 10.

Japanese-language Office Action issued in counterpart Japanese Application No. 2017-540524 dated May 7, 2019 with unverified English translation (six pages).

Extended European Search Report issued in counterpart European Application No. 16845989.9 dated Apr. 17, 2019 (nine pages).

* cited by examiner

EAR SHAPE ANALYSIS DEVICE AND EAR SHAPE ANALYSIS METHOD

BACKGROUND OF THE INVENTION

Field of the Invention

The present invention relates to a technology for analyzing an ear shape for use in calculating a head-related transfer function.

Description of the Related Art

Reproducing an audio signal representing a sound with head-related transfer functions convolved therein (binaural playback) allows a listener to perceive a sound field with a realistic feeling, in which sound field a location of a sound image can be clearly perceived. Head-related transfer functions may be calculated from a sound recorded at the ear holes of the head of a listener him/herself, for example. In practice, however, this kind of calculation is problematic in that it imposes significant physical and psychological burden on the listener during measurement.

Against the background described above, there have been proposed techniques for calculating head-related transfer functions from a sound that is recorded by using a dummy head of a given shape. Non-Patent Document 1 discloses a technique for estimating a head-related transfer function suited for a head shape of each individual listener; while Non-Patent Document 2 discloses a technique for calculating a head-related transfer function for a listener by using images of the head of the listener captured from different directions.

RELATED ART DOCUMENT

Non-Patent Documents

Non-Patent Document 1: Song Xu, Zhihong Li, and Gaviriel Salvendy, "Individualization of head-related transfer function for three-dimensional virtual auditory display: a review," Virtual Reality. Springer Berlin Heidelberg, 2007. 397-407.

Non-Patent Document 2: Dellepiane Matteo, et al. "Reconstructing head models from photographs for individualized 3D audio processing," Computer Graphics Forum. Vol. 27 NO. 7, Blackwell Publishing Ltd., 2008.

When a head-related transfer function that reflects either a head shape of a person other than a listener or a shape of a dummy head are used, it is often the case that a location of a sound image cannot be properly perceived by the listener. Moreover, even when a head-related transfer function that reflects an actual head shape of the listener are used, the listener may still not be able to properly perceive a location of a sound image if measurement accuracy is insufficient for example.

SUMMARY OF THE INVENTION

In view of the circumstances described above, an object of the present invention is to generate head-related transfer functions, the use of which enables a large number of listeners to properly perceive a location of a sound image.

To solve the problems described above, in one aspect, an ear shape analysis device includes: a sample ear analyzer configured to generate a plurality of ear shape data sets for a plurality of sample ears, each set representing a difference between a point group representative of a three-dimensional shape of a reference ear and a point group representative of a three-dimensional shape of a corresponding one of the plurality of sample ears; an averaging calculator configured to generate averaged shape data by averaging the plurality of ear shape data sets generated by the sample ear analyzer for the plurality of sample ears; and an ear shape identifier configured to identify an average ear shape of the plurality of sample ears by translating coordinates of respective points of the point group representing the three-dimensional shape of the reference ear, by using the averaged shape data.

In another aspect, an ear shape analysis method includes generating a plurality of ear shape data sets for a plurality of sample ears, each set representing a difference between a point group representative of a three-dimensional shape of a reference ear and a point group representative of a three-dimensional shape of a corresponding one of the plurality of sample ears; generating averaged shape data by averaging the plurality of ear shape data sets generated for the plurality of sample ears; and identifying an average ear shape of the plurality of sample ears, by translating coordinates of respective points of the point group representing the three-dimensional shape of the reference ear, by using the averaged shape data.

DESCRIPTION OF THE EMBODIMENTS

First Embodiment

Figure 1:
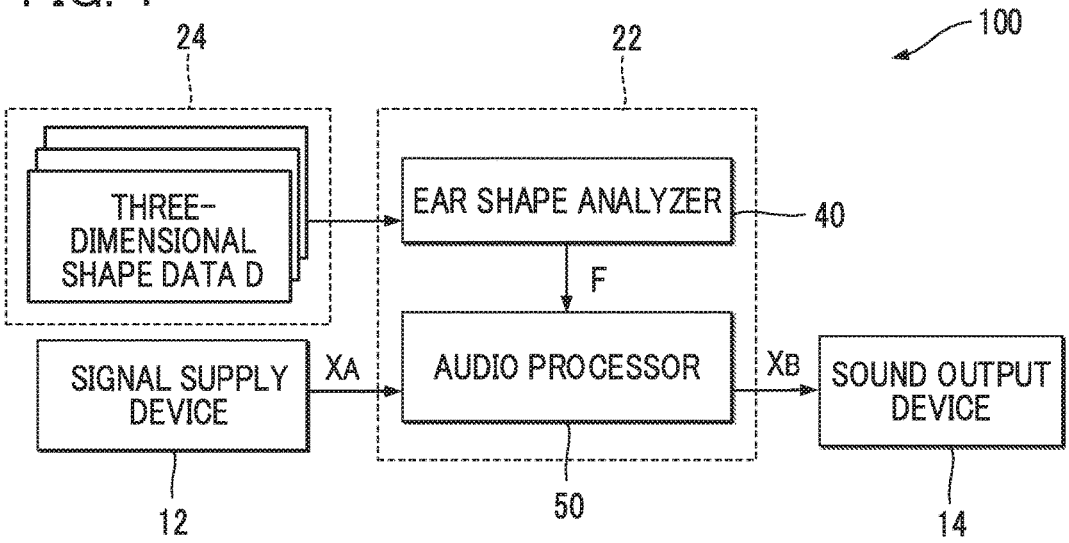
FIG. 1 is a block diagram showing a configuration of an audio processing device according to a first embodiment of the present invention.

FIG. 1 is a block diagram showing a configuration of an audio processing device 100 according to a first embodiment of the present invention. As shown in FIG. 1, connected to the audio processing device 100 of the first embodiment are a signal supply device 12 and a sound output device 14. The signal supply device 12 supplies an audio signal $X_A$ representative of a sound, such as a voice sound or a music sound, to the audio processing device 100. Specifically, a sound receiving device that receives a sound in the surroundings to generate an audio signal $X_A$; or a playback device that acquires an audio signal $X_A$ from a recording medium (either portable or in-built) and supplies the same to the audio processing device 100 can be employed as the signal supply device 12.

The audio processing device 100 is a signal processing device that generates an audio signal $X_B$ by applying audio processing to the audio signal $X_A$ supplied from the signal supply device 12. The audio signal $X_B$ is a stereo signal having two (left and right) channels. Specifically, the audio processing device 100 generates the audio signal $X_B$ by convolving a head-related transfer function (HRTF) F into the audio signal $X_A$, the head-related transfer function F comprehensively reflecting shape tendencies of multiple ears prepared in advance as samples (hereinafter, "sample ears"). In the first embodiment, a right ear is illustrated as a sample ear, for convenience. The sound output device 14 (e.g., headphones, earphones, etc.) is audio equipment, which is attached to both ears of a listener and outputs a sound that accords with the audio signal $X_B$ generated by the audio processing device 100. A user listening to a playback sound output from the sound output device 14 is able to clearly perceive a location of a sound source of a sound component. A D/A converter that converts the audio signal $X_B$ generated by the audio processing device 100 from digital to analog is not shown in the drawings, for convenience. The signal supply device 12 and/or the sound output device 14 may be mounted in the audio processing device 100.

As shown in FIG. 1, the audio processing device 100 is realized by a computer system including a control device 22 and a storage device 24. The storage device 24 stores therein a program executed by the control device 22 and various data used by the control device 22. A freely-selected form of a well-known storage media, such as a semiconductor storage medium or a magnetic storage medium, or a combination of various types of storage media may be employed as the storage device 24. A configuration in which the audio signal $X_A$ is stored in the storage device 24 (accordingly, the signal supply device 12 may be omitted) is also suitable.

The control device 22 is an arithmetic unit, such as a central processing unit (CPU), and by executing the program stored in the storage device 24, realizes a plurality of functions (an ear shape analyzer 40 and an audio processor 50). A configuration in which the functions of the control device 22 are dividedly allocated to a plurality of devices, or a configuration which employs electronic circuitry that is dedicated to realize part of the functions of the control device 22, are also applicable. The ear shape analyzer 40 generates a head-related transfer function F in which shape tendencies of multiple sample ears are comprehensively reflected. The audio processor 50 convolves the head-related transfer function F generated by the ear shape analyzer 40 into the audio signal $X_A$, so as to generate the audio signal $X_B$. Details of elements realized by the control device 22 will be described below.

Ear Shape Analyzer 40

Figure 2:
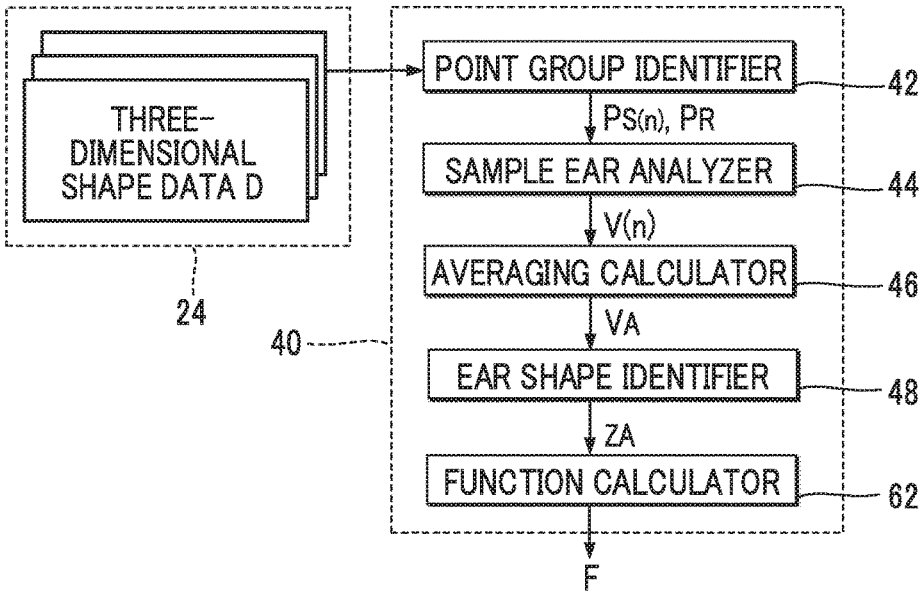
FIG. 2 is a block diagram showing a configuration of an ear shape analyzer.

FIG. 2 is a block diagram showing a configuration of the ear shape analyzer 40. As shown in FIG. 2, the storage device 24 of the first embodiment stores three-dimensional shape data D for each of N sample ears (N is a natural number of 2 or more) and one ear prepared in advance (hereinafter, "reference ear"). For example, from among a large number of ears (e.g., right ears) of a large number of unspecified human beings for whom three-dimensional shapes of these ears were measured in advance, one ear is selected as the reference ear while the rest of the ears are selected as sample ears, and three-dimensional shape data D is generated for each of the selected ears. Each three-dimensional shape data D represents a three-dimensional shape of each of the sample ears and the reference ear. Specifically, polygon mesh data representing an ear shape in a form of a collection of polygons may be suitably used as the three-dimensional shape data D, for example. As shown in FIG. 2, the ear shape analyzer 40 of the first embodiment includes a point group identifier 42, a sample ear analyzer 44, an averaging calculator 46, an ear shape identifier 48, and a function calculator 62.

The point group identifier 42 identifies a collection of multiple points (hereinafter, "point group") representing a three-dimensional shape of each sample ear, and a point group representing a three-dimensional shape of the reference ear. The point group identifier 42 of the first embodiment identifies point groups $P_S(n)$ (n=1 to N) of the N sample ears from the respective three-dimensional shape data D of the N sample ears, and identifies a point group $P_R$ of the reference ear from the three-dimensional shape data D of the reference ear. Specifically, the point group identifier 42 identifies as a point group $P_S(n)$ a collection of vertices of the polygons designated by the three-dimensional shape data D of an n-th sample ear from among the N sample ears, and identifies as the point group $P_R$ a collection of vertices of the polygons designated by the three-dimensional shape data D of the reference ear.

Figure 3:
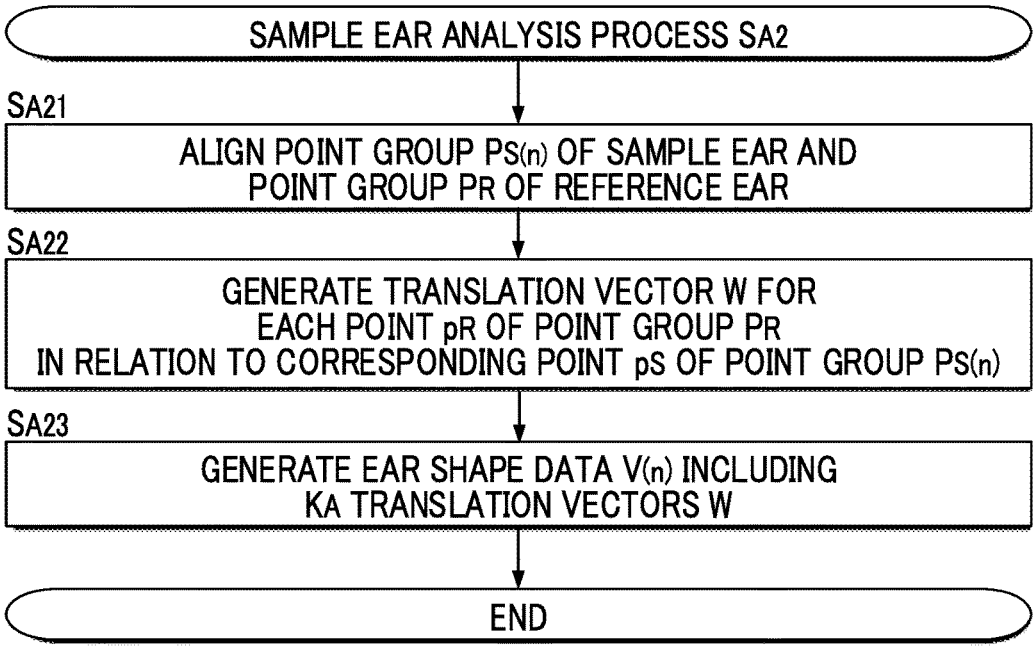
FIG. 3 is a flowchart showing a flow of a sample ear analysis process.

The sample ear analyzer 44 generates, for each of the N sample ears, ear shape data V(n) (one among ear shape data V(1) to V(N)) indicating a difference between a point group $P_S(n)$ of a sample ear and the point group $P_R$ of the reference ear, the point groups $P_S(n)$ and $P_R$ having been identified by the point group identifier 42. FIG. 3 is a flowchart showing a flow of a process S for generating ear shape data V(n) of any one of the sample ears (hereinafter, "sample ear analysis process"), the process being executed by the sample ear analyzer 44. As a result of the sample ear analysis process $S_{A2}$ in FIG. 3 being executed for each of the N sample ears, N ear shape data V(1) to V(N) are generated.

Figure 4:
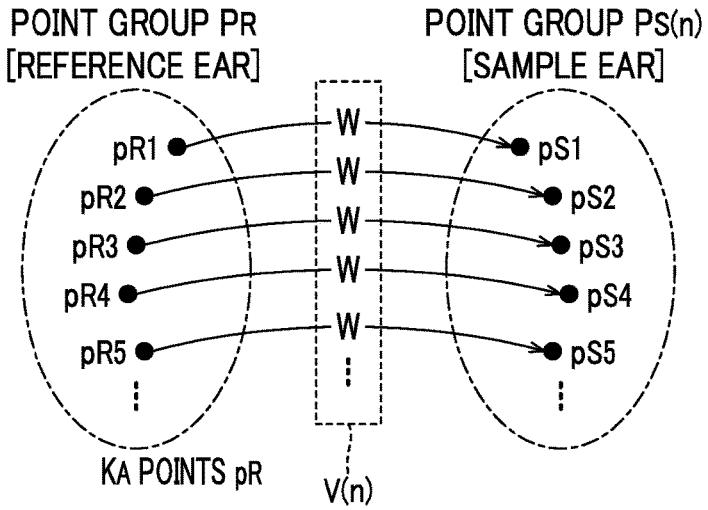
FIG. 4 is a diagram explaining the sample ear analysis process.

Upon start of the sample ear analysis process $S_{A2}$, the sample ear analyzer 44 performs point matching between a point group $P_S(n)$ of one sample ear to be processed and the point group $P_R$ of the reference ear in three-dimensional space ($S_{A21}$). Specifically, as shown in FIG. 4, the sample ear analyzer 44 identifies, for each of the plurality of points $p_R$ ($p_{R1}$, $p_{R2}$, . . . ) included in the point group $P_R$ of the reference ear, a corresponding point $p_S$ ($p_{S1}$, $p_{S2}$, . . . ) in the point group $P_S(n)$. For point matching between a point group $P_S(n)$ and the point group $P_R$, a freely-selected one of publicly-known methods can be employed. Among suitable methods is the method disclosed in Chui, Halil, and Anand Rangarajan, "A new point matching algorithm for non-rigid registration," Computer Vision and Image Understanding 89.2 (2003); 114-141, or the method disclosed in Jian, Bing, and Baba C. Vemuri, "Robust point set registration using Gaussian mixture models," Pattern Analysis and Machine Intelligence, IEEE Transaction on 33.8(2011); 1633-1645.

The sample ear analyzer 44, as shown in FIG. 4, generates, for each of $K_A$ points $p_R$ constituting the point group $P_R$ of the reference ear ($K_A$ is a natural number of 2 or more), a translation vector W indicative of a difference between the point $p_R$ and a corresponding point $p_S$ in a point group $P_S(n)$ of a sample ear ($S_{A22}$). A translation vector W is a three-dimensional vector, elements of which are constituted by coordinate values of axes set in three-dimensional space. Specifically, a translation vector W of a point $p_R$ in the point group $P_R$ expresses a location of a point $p_S$ of the point group $P_S(n)$ in three-dimensional space, based on the point $p_R$ serving as a point of reference. That is, when a translation vector W for a point $p_R$ in the point group $P_R$ is added to the same point $p_R$, a point $p_S$ within the point group $P_S(n)$ that corresponds to the point $p_R$ is reconstructed as a result. Thus, a translation vector W corresponding to a point $p_R$ within the point group $P_R$ of the reference ear may be expressed as a vector (warping vector) that serves to move or translate the point $p_R$ to another point (a point $p_S$ within the point group $P_S(n)$) that corresponds to the point $p_R$.

The sample ear analyzer 44 generates ear shape data V(n) of a sample ear, the ear shape data V(n) including $K_A$ translation vectors W generated by the above procedure ($S_{A23}$). Specifically, the ear shape data V(n) is a vector in which the $K_A$ translation vectors W are arranged in an order determined in advance with regard to the $K_A$ points $p_R$ constituting the point group $P_R$ of the reference ear. As will be understood from the above description, for each of the N sample ears, there is generated ear shape data V(n) that indicates a difference between a point group $P_S(n)$ representative of a three-dimensional shape of a sample ear and the point group $P_R$ representative of the three-dimensional shape of the reference ear.

The averaging calculator 46 in FIG. 2 generates averaged shape data $V_A$ by averaging the N ear shape data sets V(1) to V(N) generated by the sample ear analyzer 44. Specifically, the averaging calculator 46 of the first embodiment applies equation (1) shown below to the N ear shape data sets V(1) to V(N) so as to generate the averaged shape data $V_A$.

$$V_A = \frac{1}{N}\sum_{n=1}^{N} V(n) \tag{1}$$

As will be understood from the description above, the averaged shape data $V_A$ generated by the averaging calculator 46 includes (as does each ear shape data V(n)) the $K_A$ translation vectors W, one each of which corresponds to one of the different points $p_R$ of the point group $P_R$ of the reference ear. Specifically, from among the $K_A$ translation vectors W included in the averaged shape data $V_A$, a translation vector W that corresponds to a point $p_R$ of the point group $P_R$ of the reference ear is a three-dimensional vector obtained by averaging translation vectors W across the N ear shape data sets V(1) to V(N) of the sample ears, each translation vector W corresponding to the point $p_R$ of a corresponding ear shape data set V(n). While the above description illustrates a simple arithmetic average of the N ear shape data sets V(1) to V(N), a method of averaging for generating the averaged shape data $V_A$ may be calculated in a way other than that of the above example. For example, the averaged shape data $V_A$ may be generated by using a weighted sum of the N ear shape data sets V(1) to V(N), each of which is multiplied by a preset weight value for each sample ear.

Figure 5:
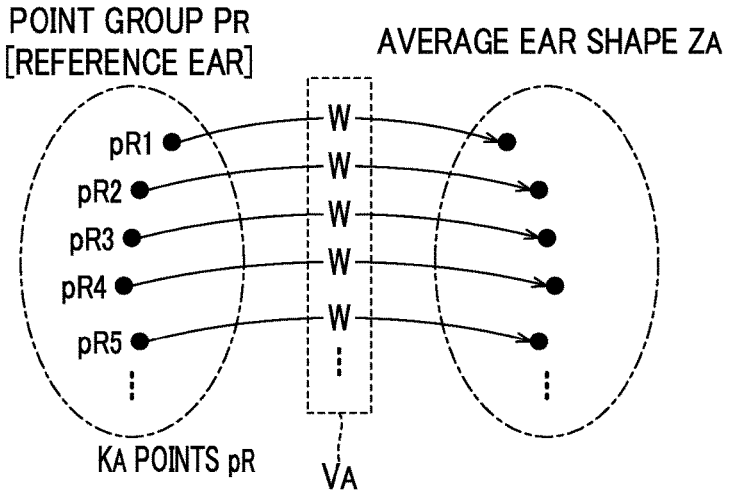
FIG. 5 is a diagram explaining an operation of an ear shape identifier.

The ear shape identifier 48 in FIG. 2 translates coordinates of the respective points $p_R$ of the point group $P_R$ of the reference ear using the averaged shape data $V_A$ calculated by the averaging calculator 46, and thereby identifies an average ear shape $Z_A$. As shown in FIG. 5, the ear shape identifier 48 adds to coordinates of each of the $K_A$ points $p_R$ of the point group $P_R$ a translation vector W that corresponds to each of the points $p_R$ within the averaged shape data $V_A$ (i.e., moves each of the points $p_R$ in three-dimensional space), with the point group $P_R$ being defined by the three-dimensional shape D of the reference ear. In this way, the ear shape identifier 48 generates three-dimensional shape data (polygon mesh data) representing the average ear shape $Z_A$. As will be understood from the foregoing description, the average ear shape $Z_A$ of the right ear is generated that reflects the ear shape data sets V(n) with regard to the N sample ears, each ear shape data set V(n) representing a difference between each point group $P_S(n)$ of a sample ear and the point group $P_R$ of the reference ear. In other words, the average ear shape $Z_A$ is a three-dimensional shape that comprehensively reflects the shapes of the N sample ears.

Figure 6:
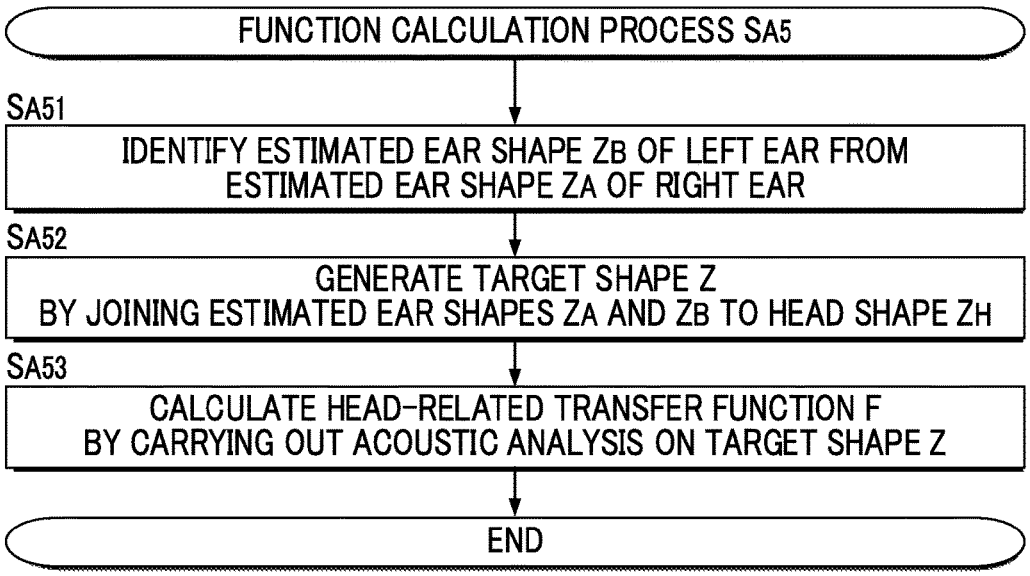
FIG. 6 is a flowchart showing a flow of a function calculation process.

The function calculator 62 calculates a head-related transfer function F that corresponds to the average ear shape $Z_A$ identified by the ear shape identifier 48. The head-related transfer function F may be expressed as a Head-Related Impulse Response (HRIR) in a time domain. FIG. 6 is a flowchart showing a flow of a process $S_{A5}$ for calculating a head-related transfer function F (hereinafter, "function calculation process"), the process being executed by the function calculator 62. The function calculation process $S_{A5}$ is executed when the average ear shape $Z_A$ is identified by the ear shape identifier 48.

Figure 7:
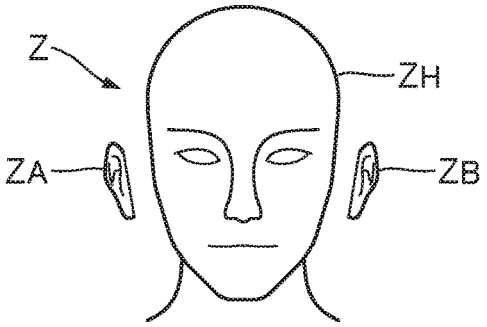
FIG. 7 is a diagram explaining a target shape used in calculating a head-related transfer function.

As shown in FIG. 7, upon start of the function calculation process $S_{A5}$, the function calculator 62 identifies an average ear shape $Z_B$ of the left ear from the average ear shape $Z_A$ of the right ear identified by ear shape identifier 48 ($S_{A51}$). Specifically, the function calculator 62 identifies, as the average ear shape $Z_B$ of the left ear, an ear shape that has a symmetric relation to the average ear shape $Z_A$. Then, as shown in FIG. 7, the function calculator 62 joins the average ear shapes $Z_A$ and $Z_B$ to a prescribed head shape $Z_H$, and thereby identifies a shape Z (hereinafter, "target shape") of the entire head including the head and the ears ($S_{A52}$). The head shape $Z_H$ is, for example, a shape of a specific dummy head, or an average shape of heads of a large number of unspecified human beings.

The function calculator 62 calculates head-related transfer functions F by carrying out acoustic analysis on the target shape Z ($S_{A53}$). Specifically, the function calculator 62 of the first embodiment calculates, for each of the right ear and the left ear, a plurality of head-related transfer functions corresponding to different directions (different azimuth angles and different elevation angles) in which a sound arrives at the target shape Z. A known analysis method, such as a boundary element method and a finite element method, can be used to calculate head-related transfer functions F. For example, techniques, such as that disclosed in Katz, Brian F G. "Boundary element method calculation of individual head-related transfer function. I. Rigid model calculation." The Journal of the Acoustical Society of America 110.5 (2001): 2440-2448, can be used to calculate head-related transfer functions F corresponding to the target shape Z.

Figure 8:
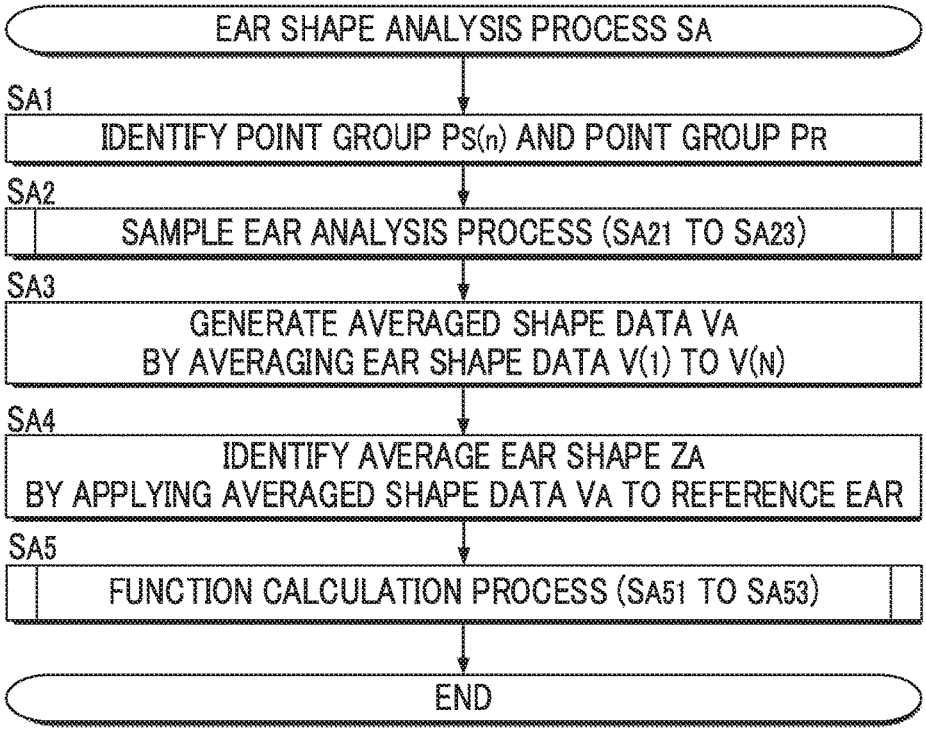
FIG. 8 is a flowchart showing a flow of an ear shape analysis process.

FIG. 8 is a flowchart showing a flow of a process $S_A$ for generating an average ear shape $Z_A$ and the head-related transfer function F (hereinafter, "ear shape analysis process"), the process being executed by the ear shape analyzer 40 of the first embodiment. The ear shape analysis process $S_A$ in FIG. 8 is executed when, for example, an instruction is given by the user to generate a head-related transfer function F.

Upon start of the ear shape analysis process $S_A$, the point group identifier 42 identifies the respective point groups $P_S(n)$ ($P_S(1)$ to $P_S(N)$) of the N sample ears and the point group $P_R$ of the reference ear from the respective three-dimensional shape data D ($S_{A1}$). The sample ear analyzer 44 executes the sample ear analysis process $S_{A2}$ ($S_{A21}$ to $S_{A23}$) in FIG. 3 using the point groups $P_S(n)$ of the sample ears and the point group $P_R$ of the reference ear identified by the point group identifier 42, and thereby generates N ear shape data sets V(1) to V(N), which correspond to different sample ears.

The averaging calculator 46, by averaging the N ear shape data sets V(1) to V(N) generated by the sample ear analyzer 44, generates averaged shape data $V_A$ ($S_{A3}$). The ear shape identifier 48 identifies the average ear shape $Z_A$ by translating the coordinates of the respective points $p_R$ of the point group $P_R$ of the reference ear by using the averaged shape data $V_A$ ($S_{A4}$). The function calculator 62 executes the function calculation process $S_{A5}$ ($S_{A51}$ to $S_{A53}$) shown in FIG. 6, and thereby calculates head-related transfer functions F for the target shape Z of the entire head including the average ear shape $Z_A$ identified by the ear shape identifier 48. As a result of the ear shape analysis process $S_A$ illustrated above being executed, the head-related transfer functions F are generated in which shape tendencies of the N sample ears are comprehensively reflected. The generated head-related transfer functions F are then stored in the storage device 24.

Audio Processor 50

Figure 9:
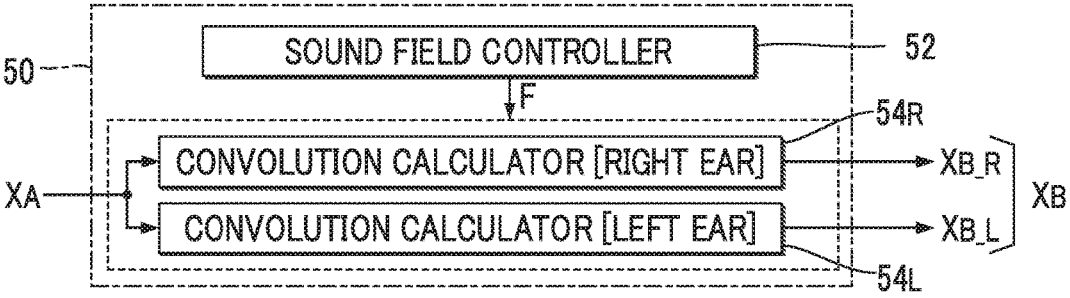
FIG. 9 is a block diagram showing a configuration of an audio processor.

The audio processor 50 in FIG. 1 convolves the head-related transfer functions F generated by the ear shape analyzer 40 into the audio signal $X_A$, to generate the audio signal $X_B$. FIG. 9 is a block diagram showing a configuration of the audio processor 50. As shown in FIG. 9, the audio processor 50 of the first embodiment includes a sound field controller 52 and convolution calculators 54R and 54L.

The user can instruct to the audio processing device 100 sound field conditions including a sound source location and a listening location in a virtual acoustic space. The sound field controller 52 calculates a direction in which a sound arrives at the listening location in the acoustic space from a relation between the sound source location and the listening location. The sound field controller 52 selects, from the storage device 24, head-related transfer functions F for the respective ones of the left and right ears that correspond to the direction in which the sound arrives at the listening location, from among head-related transfer functions F calculated by the ear shape analyzer 40. The convolution calculator 54R generates an audio signal $X_{B_R}$ for a right channel by convolving into the audio signal $X_A$ the head-related transfer function F of the right ear selected by the sound field controller 52. The convolution calculator 54L generates an audio signal $X_{B_L}$ for a left channel by convolving into the audio signal $X_A$ the head-related transfer function F of the left ear selected by the sound field controller 52. Convolution of the head-related transfer function F in a time domain (head-related impulse response) may be replaced by multiplication in a frequency domain.

In the first embodiment, as described above, an ear shape data set V(n) representative of a difference between a point group $P_S(n)$ of a sample ear and the point group $P_R$ of the reference ear is generated for each of the N sample ears. The coordinates of the respective points $p_R$ of the point group $P_R$ of the reference ear are translated by use of the averaged shape data $V_A$ obtained by averaging the ear shape data sets V(n) for the N sample ears. As a result, the average ear shape $Z_A$, which comprehensively reflects shape tendencies of the N sample ears, is identified. As such, there can be generated, from the average ear shape $Z_A$, a head-related transfer function F, the use of which enables a large number of listeners to perceive a proper location of a sound image.

Second Embodiment

A second embodiment of the present invention will be described below. In the different modes described below, elements having substantially the same actions and/or functions as those in the first embodiment will be denoted by the same reference symbols as those used in the description of the first embodiment, and detailed description thereof will be omitted as appropriate.

In the sample ear analysis process $S_{A2}$ (FIG. 3) in the first embodiment, for each of all points $p_R$ constituting the point group $P_R$ of the reference ear, a translation vector W is calculated between each point $p_S$ of the sample ear and each point $p_R$ of the reference ear. A sample ear analyzer 44 of the second embodiment calculates a translation vector W between each of $K_A$ points $p_R$ constituting a part (hereinafter, "first group") of the point group $P_R$ of the reference ear and a corresponding point $p_S$ of a point group $P_S(n)$ of a sample ear. In other words, while in the first embodiment the total number of the points $p_R$ constituting the point group $P_R$ of the reference ear is expressed as "$K_A$", the number "$K_A$" in the second embodiment corresponds to the number of points $p_R$ constituting the first group of the point group $P_R$ of the reference ear.

Figure 10:
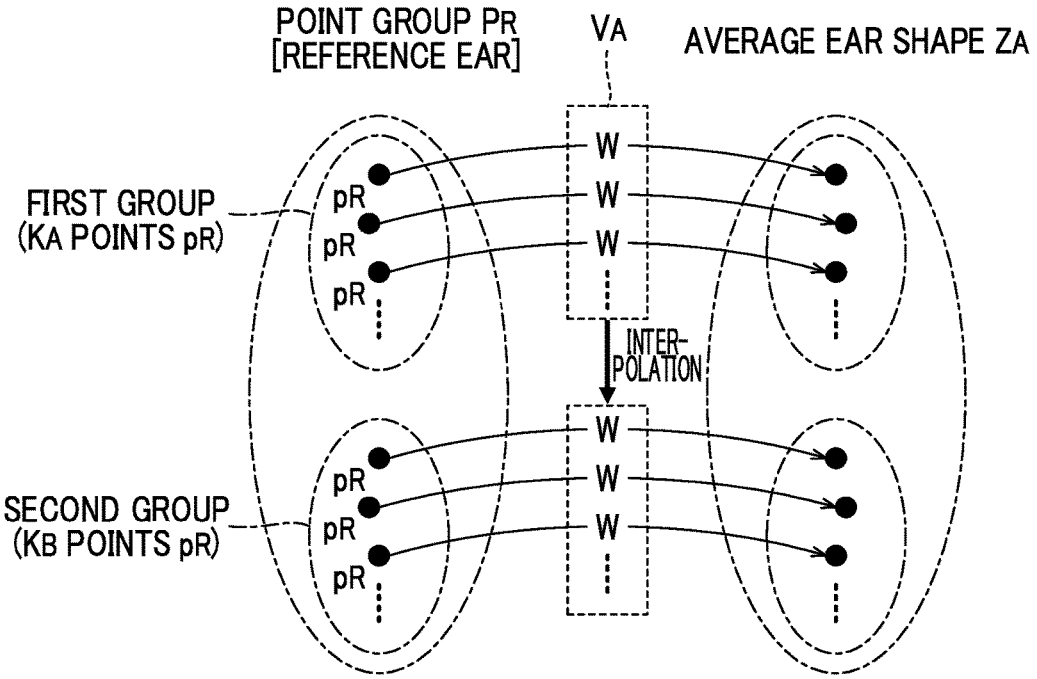
FIG. 10 is a diagram explaining an operation of an ear shape identifier according to a second embodiment.

An ear shape data set V(n) generated by the sample ear analyzer 44 for each sample ear includes $K_A$ translation vectors W that correspond to the points $p_R$ constituting the first group of the point group $P_R$ of the reference ear. Similarly to the ear shape data set V(n), the averaged shape data $V_A$ generated by the averaging calculator 46 by averaging the N ear shape data sets V(1) to V(n) includes $K_A$ translation vectors W corresponding to the points $p_R$ constituting the first group, which is a part of the point group $P_R$ of the reference ear, as shown in FIG. 10. In other words, translation vectors W corresponding to respective points $p_R$ constituting a subset (hereinafter, "second group"), other than the first group, of the point group $P_R$ of the reference ear are not included in the averaged shape data $V_A$ generated by the averaging calculator 46.

Figure 11:
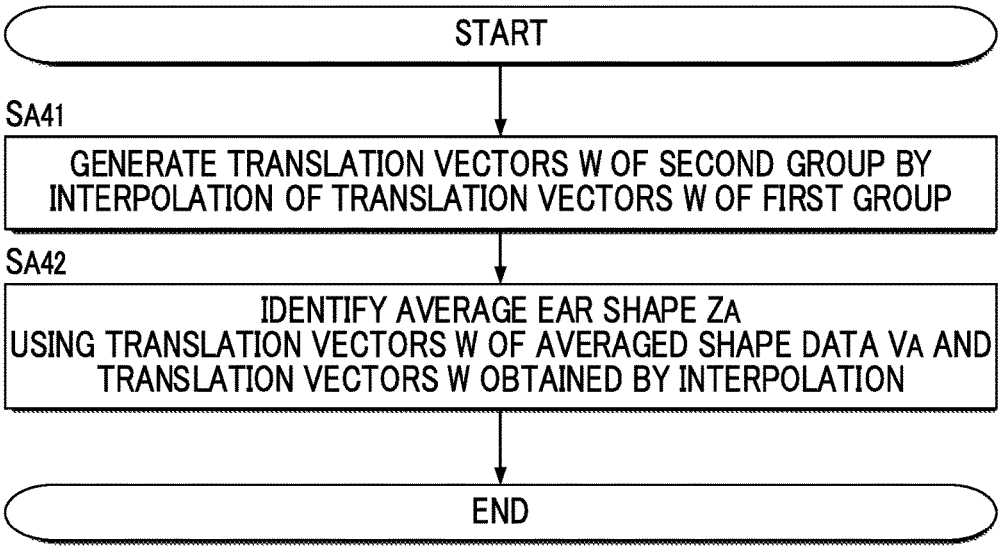
FIG. 11 is a flowchart showing a flow of an operation of the ear shape identifier according to the second embodiment.

FIG. 11 is a flowchart showing a flow of an operation carried out by an ear shape identifier 48 of the second embodiment to identify an average ear shape $Z_A$ using the averaged shape data $V_A$. The process in FIG. 11 is executed in step $S_{A4}$ of the ear shape analysis process $S_A$ shown in FIG. 8.

As shown in FIG. 10, the ear shape identifier 48 of the second embodiment generates $K_B$ translation vectors W that correspond to the respective points $p_R$ constituting the second group of the point group $P_R$ of the reference ear, by interpolation of the $K_A$ translation vectors W included in the averaged shape data $V_A$ generated by the averaging calculator 46 ($S_{A41}$). Specifically, a translation vector W of a point $p_R$ (hereinafter, "specific point") within the second group in the point group $P_R$ of the reference ear is obtained as expressed by equation (2) below; that is, the translation vector W of the specific point $p_R$ is obtained by calculating a weighted sum of, from among the $K_A$ translation vectors W of the averaged shape data $V_A$, translation vectors W(q) (q=1 to Q (Q is a natural number of 2 or more)) that correspond to Q points $p_R(1)$ to $p_R(Q)$ located in the proximity of the specific point $p_R$ within the first group.

$$W = \sum_{q=1}^{Q} \frac{e^{-a \cdot d^2(q)}}{\sum_{q=1}^{Q} e^{-a \cdot d^2(q)}} W(q) \tag{2}$$

In equation (2), the sign "e" is a base of a natural logarithm, and the sign "a" is a prescribed constant (positive number). The sign d(q) stands for a distance (e.g., a Euclidean distance) between a point $p_R(q)$ in the first group and the specific point $p_R$. As will be understood from equation (2), a weighted sum of the Q translation vectors W(1) to W(Q), which is calculated by using weight values in accordance with respective distances d(q) between the specific point $p_R$ and the respective points $p_R(q)$, is obtained as the translation vector W of the specific point $p_R$. As a result of the above process executed by the ear shape identifier 48, a translation vector W is calculated for all ($K_A$+$K_B$) points $p_R$ constituting the point group $P_R$ of the reference ear. The number Q of points $p_R(q)$ in the first group that are taken into account in calculating the translation vector W of the specific point $p_R$ is typically set to a numerical value that is lower than the number $K_A$ of the points $p_R$ constituting the first group. However, the number Q of points $p_R(q)$ may be set to a numerical value equal to the number $K_A$ (that is, the translation vector W of the specific point $p_R$ may be calculated by interpolation of translation vectors W of all points $p_R$ belonging to the first group).

The ear shape identifier 48, similarly to the first embodiment, translates the coordinates of the respective points $p_R$ of the point group $P_R$ of the reference ear by using the translation vectors W corresponding to the points $p_R$ of the reference ear, and thereby identifies an average ear shape $Z_A$ ($S_{A42}$). Specifically, as shown in FIG. 10, the ear shape identifier 48 translates the coordinates of each of the $K_A$ points $p_R$ constituting the first group of the point group $P_R$ of the reference ear, by using a corresponding one of the $K_A$ translation vectors W of the averaged shape data $V_A$. Additionally, the ear shape identifier 48 translates the coordinates of each of the points $p_R$ constituting the second group of the point group $P_R$ of the reference ear, by using a corresponding one of $K_B$ translation vectors W obtained by the interpolation expressed by equation (2) (specifically, the translation vectors W obtained by the interpolation are added to the coordinates of the respective points $p_R$). In this way, the ear shape identifier 48 identifies the average ear shape $Z_A$ expressed by the ($K_A$+$K_B$) points. Calculation of a head-related transfer function F using the average ear shape $Z_A$ and convolution of the head-related transfer function F into an audio signal $X_A$ are substantially the same as those in the first embodiment.

Substantially the same effects as those of the first embodiment are obtained in the second embodiment. Furthermore, in the second embodiment, translation vectors W corresponding to the points $p_R$ constituting the second group of the point group $P_R$ of the reference ear are generated by interpolation of Q translation vectors W(1) to W(Q) included in the averaged shape data $V_A$. Thus the sample ear analyzer 44 need not generate translation vectors W for the entire point group $P_R$ of the reference ear. As a result, a processing load when the sample ear analyzer 44 generates ear shape data V(n) is reduced.

Third Embodiment

Figure 12:
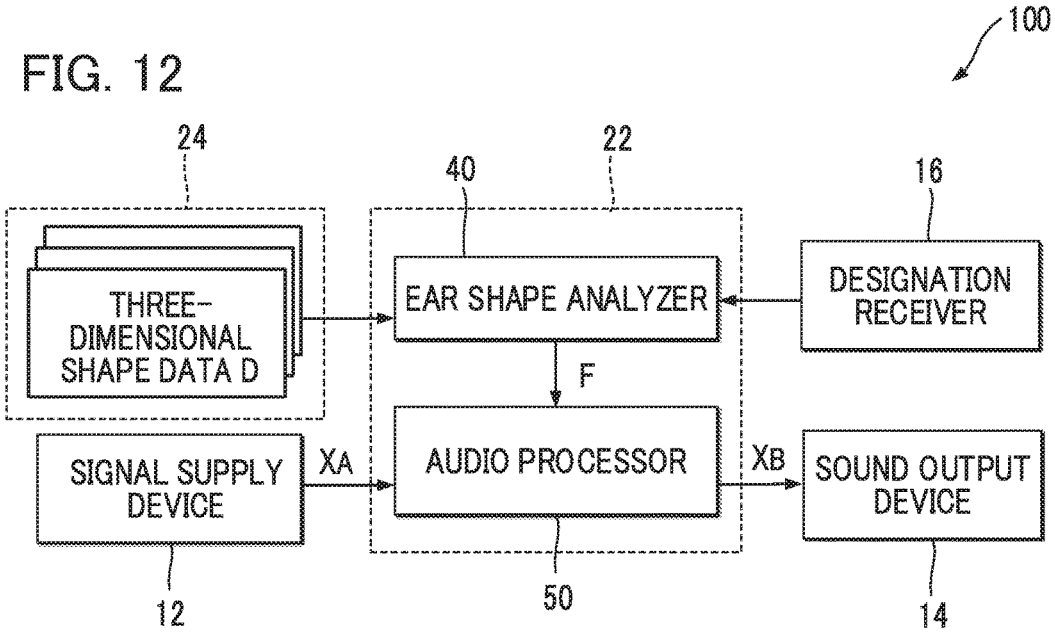
FIG. 12 is a block diagram showing a configuration of an audio processing device according to a third embodiment.

A third embodiment of the present invention will be described below. FIG. 12 is a block diagram showing a configuration of an audio processing device 100 according to the third embodiment. As shown in the figure, the audio processing device 100 of the third embodiment includes a designation receiver 16 that receives designation of one of a plurality of attributes in addition to the configuration of the audio processing device 100 of the first embodiment. While the attributes may include a variety of freely-selected attributes, examples thereof include gender, age (e.g., adult or child), physique, race, and other attributes related to a person (hereinafter, "subject") for whom a sample ear is measured, as well as categories (types) or the like into which ear shapes are grouped according to their general characteristics. The designation receiver 16 of the present embodiment receives designation of attributes under age (adult or child) and gender (male or female).

Figure 13:
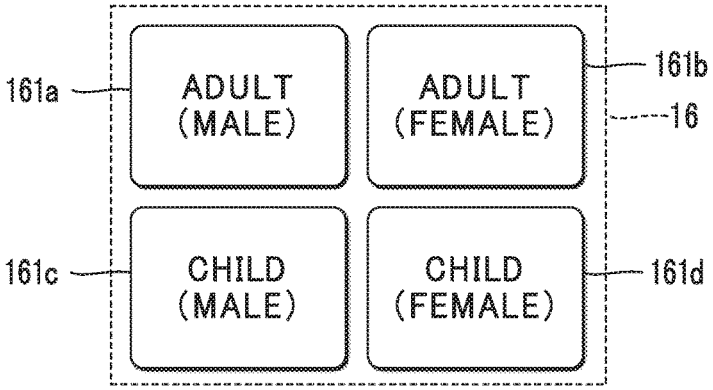
FIG. 13 is a display example of a designation receiver.

The designation receiver 16 may be, for example, a touch panel having an integrated input device and display device (e.g., a liquid-crystal display panel). FIG. 13 shows a display example of the designation receiver 16. As shown in the figure, there are displayed on the designation receiver 16 button-type operation elements 161 (161*a*, 161*b*, 161*c*, and 161*d*) indicating "ADULT (MALE)", "ADULT (FEMALE)", "CHILD (MALE)", and "CHILD (FEMALE)". The listener can designate one of the pairs of attributes by touching a corresponding one of the button-type operation elements 161 with a finger or the like.

When a pair of attributes is designated at the designation receiver 16, the ear shape analyzer 40 of the third embodiment extracts N three-dimensional shape data sets D having the designated attributes from a storage device 24, and generates an ear shape data set V(n) for each of the extracted three-dimensional shape data sets D. In other words, the ear shape analyzer 40 generates a head-related transfer function F that comprehensively reflect shape tendencies of, from among the plurality of sample ears, sample ears that have the attributes designated at the designation receiver 16. The number N can vary depending on a designated attribute(s).

Figure 14:
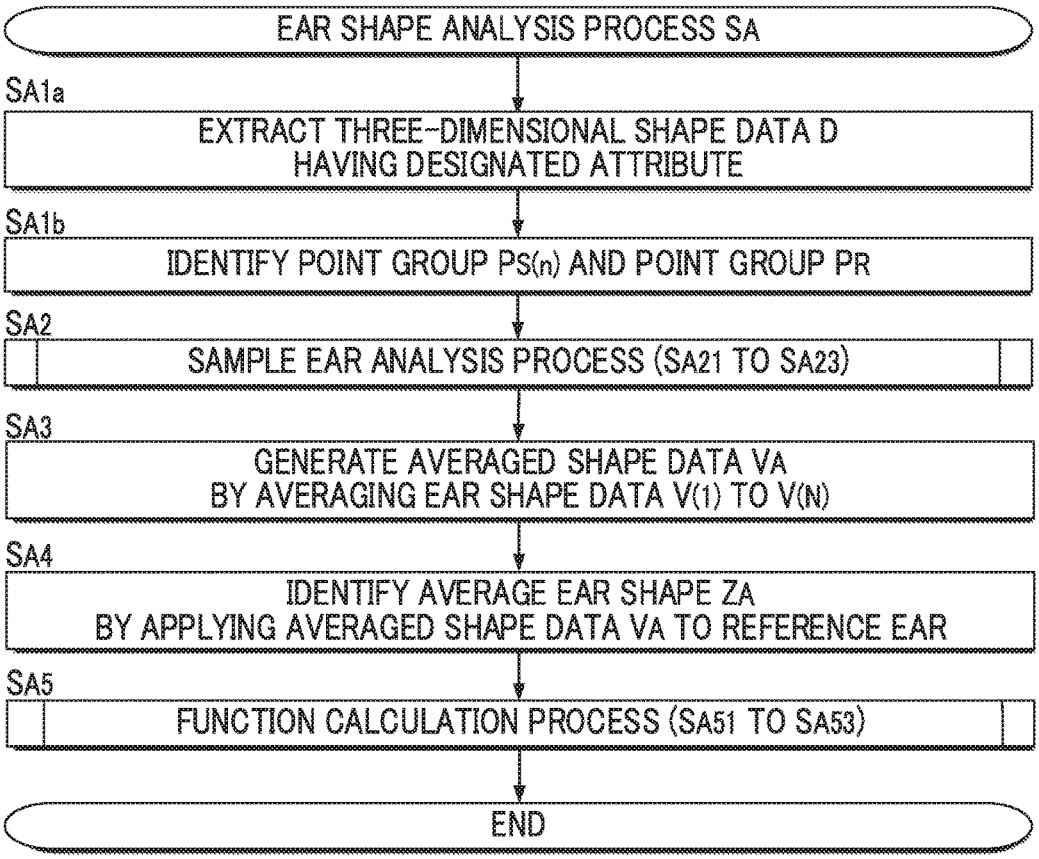
FIG. 14 is a flowchart showing a flow of an ear shape analysis process.

FIG. 14 is a flowchart showing a flow of the ear shape analysis process $S_A$ according to the third embodiment. The ear shape analysis process $S_A$ is started when an attribute is designated at the designation receiver 16. In the present example, it is assumed that the listener touches the button-type operation element 161*a* indicating "ADULT (MALE)". The ear shape analyzer 40 extracts, from among the multiple three-dimensional shape data sets D stored in the storage device 24, N three-dimensional shape data sets D that have the attributes (of "ADULT" and "MALE") designated at the designation receiver 16 ($S_{A1a}$). The gender and age of a subject of a sample ear corresponding to each three-dimensional shape data set D are stored in advance, in association with each three-dimensional shape data set D stored in the storage device 24. The point group identifier 42 identifies point groups $P_S(n)$ of respective N sample ears and a point group $P_R$ of a reference ear from the N three-dimensional shape data sets D (three-dimensional shape data sets D having the attributes of "ADULT" and "MALE") extracted in step $S_{A1a}$ ($S_{A1b}$). The sample ear analyzer 44 generates an ear shape data set V(n) for each of the N three-dimensional shape data sets D ($S_{A2}$). After execution of subsequent processes in steps $S_{A3}$ and $S_{A4}$, the function calculator 62 generates head-related transfer functions F that reflect shapes of sample ears having the attributes of "ADULT" and "MALE" in step $S_{A5}$.

In the third embodiment, as described above, ear shape data V(n) is generated for sample ears having a designated attribute(s). Thus, when the listener designates a desired attribute(s), an average ear shape $Z_A$ of sample ears having the designated attribute(s) is identified. Consequently, as the listener designates his/her own attribute(s) at the designation receiver 16, head-related transfer functions F that are more suitable for the attribute(s) of the listener can be generated, in contrast to a configuration in which no attribute is taken into consideration. Accordingly, there is an increased probability that the listener will perceive a location of a sound image more properly.

A range of selection of attributes that can be designated is not limited to the above example. For example, instead of button-type operation elements 161, an input screen may display multiple options (e.g., "MALE", "FEMALE", and "NOT SPECIFIED" for "GENDER") for each type of attributes, such as gender, age, and physique, and the listener may select therefrom a desired option. By selecting "NOT SPECIFIED", the listener can choose not to designate the attribute "GENDER". In this manner, for each type of attributes, the listener may choose whether or not to designate an attribute. In the present embodiment, attributes of a subject of a sample ear corresponding to each three-dimensional shape data D are stored in the storage device 24 in advance in association with each three-dimensional shape data D, and three-dimensional shape data sets D that accord with an attribute(s) designated at the designation receiver 16 are extracted. Therefore, head-related transfer functions F that match (an) attribute(s) of the listener with a granularity desired by the listener can be generated. For example, if the listener designates a plurality of attributes, head-related transfer functions F are generated from three-dimensional shape data sets D that satisfy an AND (logical conjunction) condition of the plurality of attributes, whereas if the listener designates a single attribute, head-related transfer functions F satisfying a condition of the single attribute are generated. Thus, with an increase in the number of designated attributes, head related transfer functions F that match the attributes of the listener with a finer granularity are generated. In other words, it is possible to generate head-related transfer functions F that preferentially reflect attributes that the listener deems important, i.e., it is possible to generate head-related transfer functions F for which influences of attributes that the listener deems unimportant can be suppressed.

Fourth Embodiment

Figure 15:
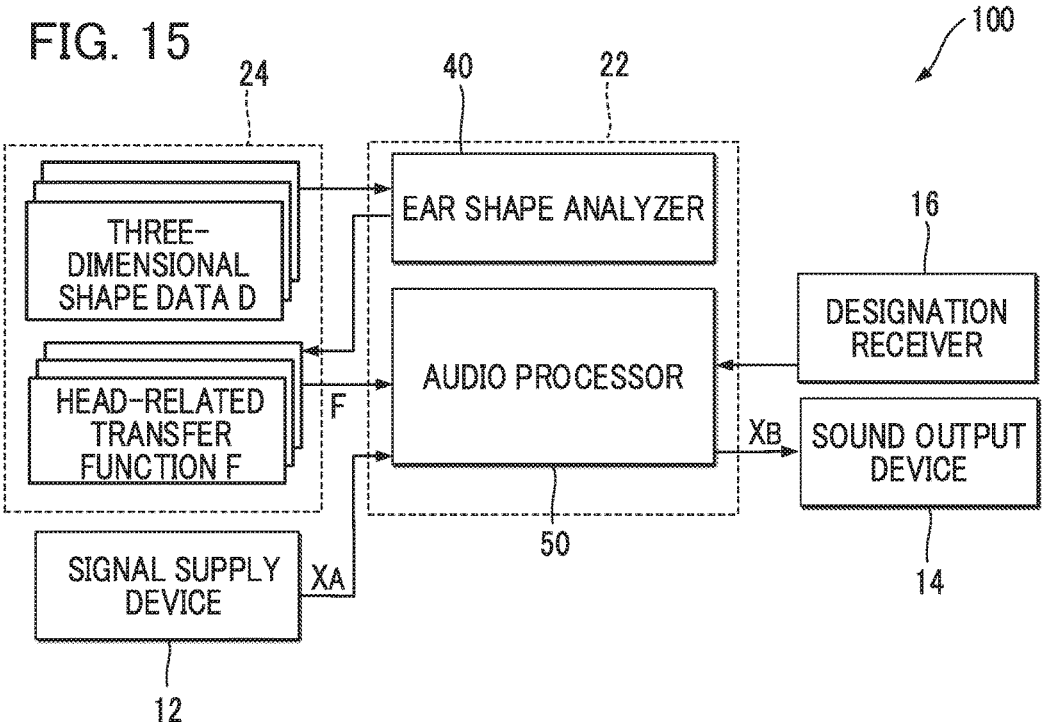
FIG. 15 is a block diagram showing a configuration of an audio processing device according to a fourth embodiment.

A fourth embodiment of the present invention will be described below. FIG. 15 is a block diagram showing an audio processing device 100 according to the fourth embodiment. As shown in the figure, the audio processing device 100 of the fourth embodiment has substantially the same configuration as that of the third embodiment, except that a plurality of head-related transfer functions F are stored in a storage device 24. Specifically, in the fourth embodiment, an ear shape analyzer 40 calculates in advance head-related transfer functions F for each of a plurality of attributes. Even more specifically, the ear shape analyzer 40 of the fourth embodiment executes in advance the ear shape analysis process $S_A$ shown in FIG. 14 for each of a plurality of attributes, and stores in the storage device 24 a plurality of (sets of) head-related transfer functions F calculated for different attributes. Each (set) of the head-related transfer functions F consists of a collection of head-related transfer functions (having mutually different directions from which a sound arrives at a target shape Z) calculated by a function calculator 62 of the ear shape analyzer 40. When an attribute is designated at a designation receiver 16, an audio processor 50 reads from the storage device 24 a head-related transfer function F that accord with the designated attribute, and convolves the same into an audio signal $X_A$ to generate an audio signal $X_B$. In the present embodiment, one of the head-related transfer functions F calculated for each attribute is designated at the designation receiver 16, and therefore, in a case where the listener designates a desired head-related transfer function F (i.e., a head-related transfer function F corresponding to a desired attribute), the listener is able to more properly perceive a location of a sound image, in contrast to a configuration in which no attribute is taken into consideration.

Modifications

The embodiments described above can be modified in a variety of ways. Specific modes of modification will be illustrated in the following. Two or more modes selected from the following examples may be combined may be appropriately combined as long as they are not in conflict with one another.

(1) In the embodiments described above, an average ear shape $Z_A$ of the right ear is identified and an average ear shape $Z_B$ of the left ear is identified from the average ear shape $Z_A$, and then the average ear shapes $Z_A$ and $Z_B$ are joined to a head shape $Z_H$ to generate a target shape Z. However, a method of generating a target shape Z is not limited to the above example. For example, the ear shape analyzer 40 may execute substantially the same ear shape analysis process $S_A$ as that in the first embodiment for each of the right and left ears, so as to generate an average ear shape $Z_A$ of the right ear and an average ear shape $Z_B$ of the left ear, individually and independently. As an another example, by executing substantially the same process as the ear shape analysis process $S_A$ illustrated in the above-described embodiments, an average shape of heads of a large number of unspecified human beings may be generated as a head shape $Z_H$.

(2) A configuration of the audio processor 50 is not limited to the example given in the embodiments described above. For example, a configuration shown in FIG. 16 or FIG. 17 may be employed. An audio processor 50 shown in FIG. 16 includes a sound field controller 52, a convolution calculator 54R, a convolution calculator 54L, a reverberation generator 56, and a signal adder 58. Operations of the convolution calculators 54R and 54L are substantially the same as those in the first embodiment. The reverberation generator 56 generates from an audio signal $X_A$ a reverberant sound that occurs in a virtual acoustic space. Acoustic characteristics of the reverberant sound generated by the reverberation generator 56 are controlled by the sound field controller 52. The signal adder 58 adds the reverberant sound generated by the reverberation generator 56 to a signal processed by the convolution calculator 54R, and thereby generates an audio signal $X_{B_R}$ for the right channel. Likewise, the signal adder 58 adds the reverberant sound generated by the reverberation generator 56 to a signal processed by the convolution calculator 54L, and thereby generates an audio signal $X_{B_L}$ for the left channel.

Figure 17:
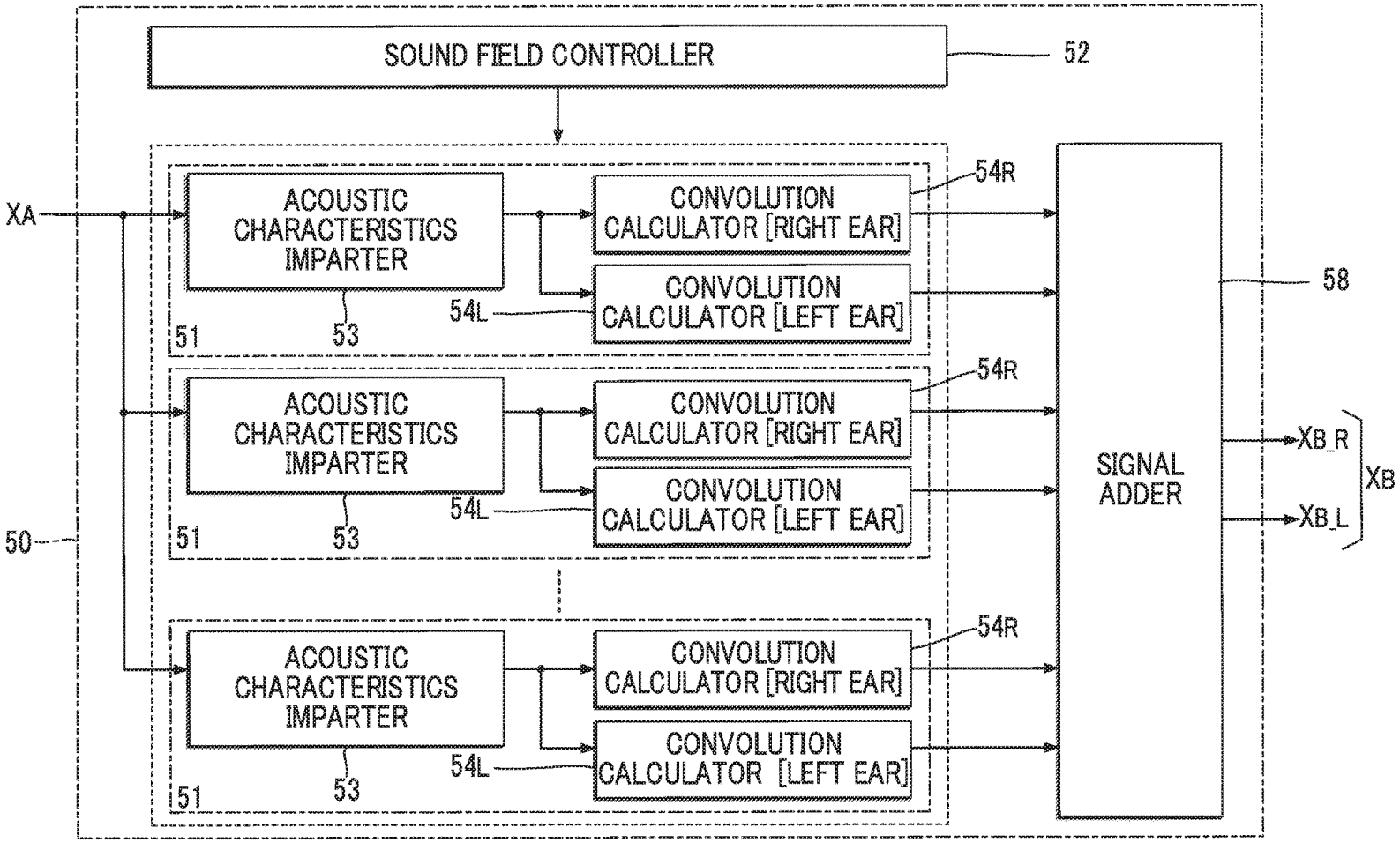
FIG. 17 is a block diagram showing a configuration of an audio processor according to another modification.

The audio processor 50 shown in FIG. 17 includes a sound field controller 52, a plurality of adjustment processors 51, and a signal adder 58. Each of the adjustment processors 51 generates an early-reflected sound that simulates a corresponding one of different propagation paths through each of which a sound produced at a sound source location arrives at a listening location in a virtual acoustic space. Specifically, an adjustment processors 51 includes an acoustic characteristic imparter 53, a convolution calculator 54R, and a convolution calculator 54L. The acoustic characteristic imparter 53 adjusts an amplitude and/or a phase of an audio signal $X_A$, and thereby simulates wall reflection in a propagation path in the acoustic space, as well as delay and distance attenuation due to propagation over a distance in the propagation path. Characteristics imparted by each acoustic characteristic imparter 53 to an audio signal $X_A$ are controlled by the sound field controller 52 so as to be variable in accordance with a variable pertaining to the acoustic space (e.g., the size or the shape of the acoustic space, sound reflectance of a wall, a sound source location, a listening location).

The convolution calculator 54R convolves a head-related transfer function F of the right ear selected by the sound field controller 52 into the audio signal $X_A$, the acoustic characteristics of which have been changed by the acoustic characteristic imparter 53. The convolution calculator 54L convolves a head-related transfer function F of the left ear selected by the sound field controller 52 into the audio signal $X_A$, the acoustic characteristics of which have been changed by the acoustic characteristic imparter 53. The sound field controller 52 provides to the convolution calculator 54R a head-related transfer function F from a position of a mirror-image sound source to the right ear on a propagation path in the acoustic space, and provides to the convolution calculator 54L a head-related transfer function F from the position of the mirror-image sound source to the left ear on a propagation path in the acoustic space. The signal adder 58 adds up signals processed by the convolution calculators 54R across the plurality of adjustment processors 51, and thereby generates an audio signal $X_{B_R}$ for the right channel. Likewise, the signal adder 58 adds up signals processed by the convolution calculators 54L across the plurality of adjustment processors 51, and thereby generates an audio signal $X_{B_L}$ for the left channel.

Figure 16:
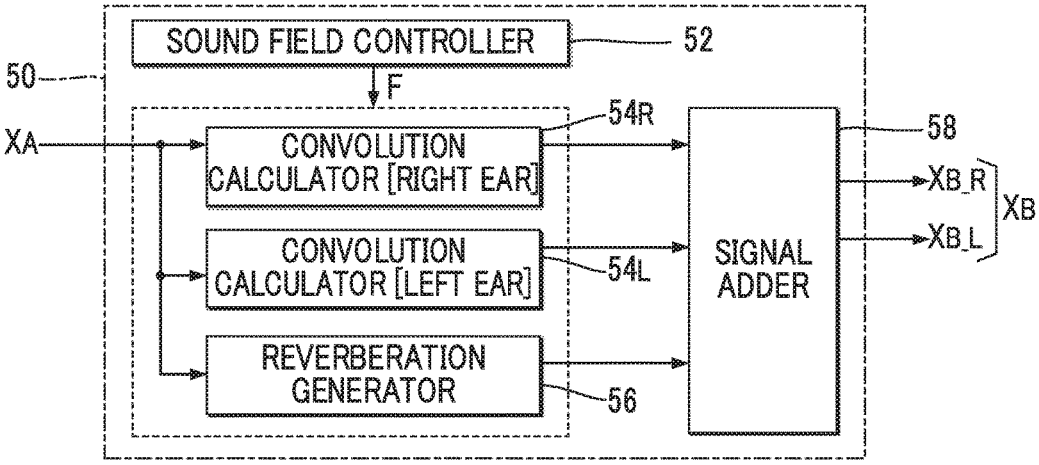
FIG. 16 is a block diagram showing a configuration of an audio processor according to a modification.

The configurations in FIGS. 16 and 17 may be combined. For example, there may be generated an audio signal $X_B$ that includes early-reflected sounds generated by the respective adjustment processors 51 in FIG. 17 and a reverberant (late reverberant) sound generated by the reverberation generator 56 in FIG. 16.

(3) In the embodiments described above, an audio processing device 100 that includes an ear shape analyzer 40 and an audio processor 50 is illustrated, but the present invention may be expressed as an ear shape analysis device that includes an ear shape analyzer 40. An audio processor 50 may or may not be included in the ear shape analysis device. The ear shape analysis device may be realized for instance by a server device that is capable of communicating with a terminal device via a communication network, such as a mobile communication network and the Internet. Specifically, the ear shape analysis device transmits to the terminal device a head-related transfer function F generated in accordance with any one of the methods described in the embodiments above, and an audio processor 50 of the terminal device convolves the head-related transfer function F into an audio signal $X_A$ so as to generate an audio signal $X_B$.

Figure 18:
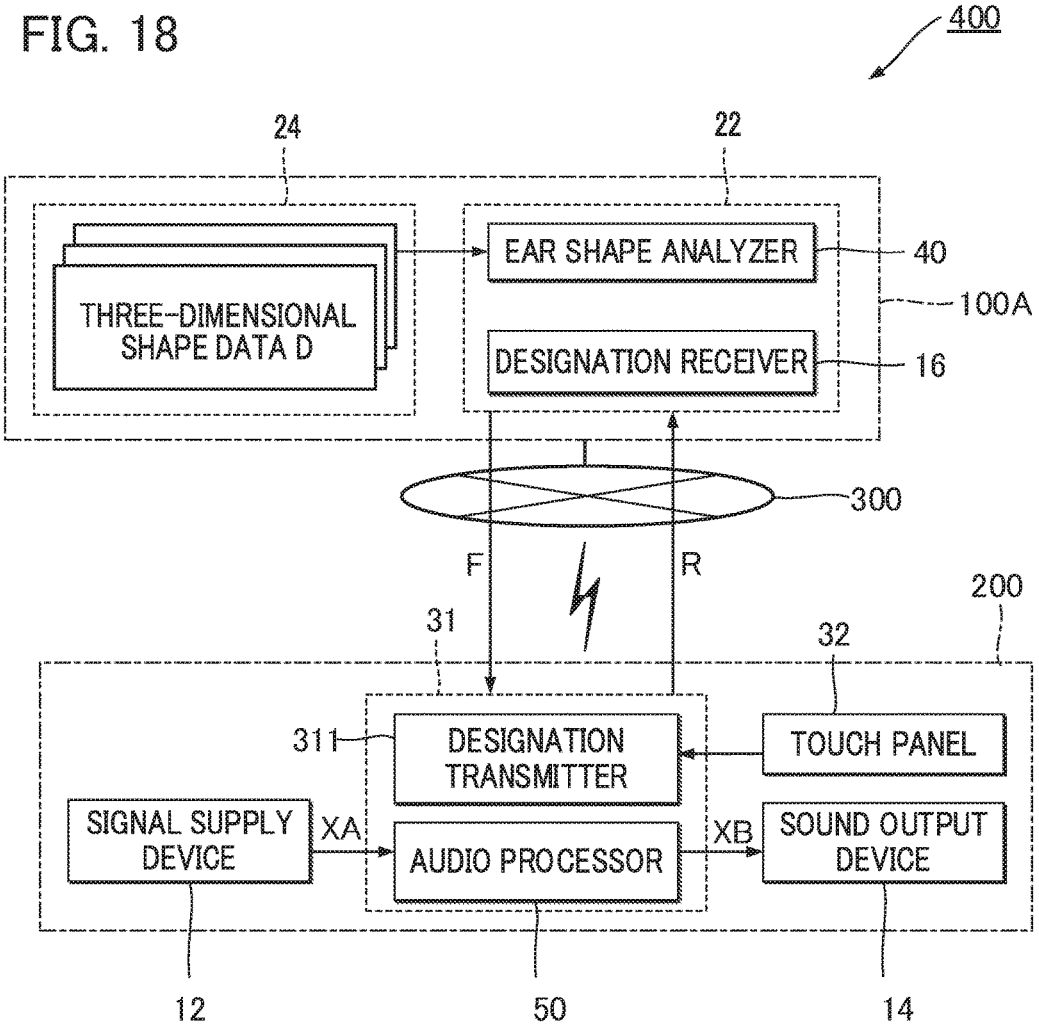
FIG. 18 is a block diagram showing a configuration of an audio processing system according to yet another modification.

(4) In the third embodiment, designation of an attribute is received through an input operation performed on a display screen displayed on the designation receiver 16 of the audio processing device 100. Instead, a configuration may be adopted where an attribute is designated to an information processing device by use of a terminal device of the listener connected to the information processing device via a communication network. FIG. 18 is a block diagram showing a configuration of an audio processing system 400 according to a modification of the third embodiment. As shown in the figure, the audio processing system 400 of the present modification includes an information processing device 100A and a terminal device 200 of the listener connected to the information processing device 100A via a communication network 300, such as the Internet. The terminal device 200 may be for instance a portable communication terminal, such as a portable telephone and a smartphone. The information processing device 100A includes a storage device 24, an ear shape analyzer 40, and a designation receiver 16. The terminal device 200 includes a signal supply device 12, a control device 31 including an audio processor 50 and a designation transmitter 311, a sound output device 14, and a touch panel 32. The control device 31 is an arithmetic unit, such as a CPU, and by executing a program stored in a storage device (not shown), realizes a plurality of functions (the audio processor 50 and the designation transmitter 311). The touch panel 32 is a user interface having an integrated input device and display device (e.g., liquid-crystal display panel), and displays a screen on which a button-type operation element 161 such as that illustrated in the third embodiment is shown.

In the above configuration, the terminal device 200 receives through the touch panel 32 an operation performed by the listener to designate an attribute. The designation transmitter 311 transmits a request R including attribute information indicative of the designated attribute to the information processing device 100A via the communication network 300. The designation receiver 16 of the information processing device 100A receives the request R including the attribute information from the terminal device 200 (i.e., receives designation of an attribute(s)). The ear shape analyzer 40 calculates, by use of the method described in the third embodiment, a head-related transfer function F that reflects sample ears having the designated attribute(s), and transmits the same to the terminal device 200 via the communication network 300. The head-related transfer function F transmitted to the terminal device 200 consists of a collection of head-related transfer functions (having different directions from which a sound arrives at the target shape Z) calculated by the function calculator 62 of the ear shape analyzer 40. At the terminal device 200, the audio processor 50 convolves one among the received head-related transfer functions F into an audio signal $X_A$ to generate an audio signal $X_B$, and the sound output device 14 outputs a sound that accords with the audio signal $X_B$. As will be understood from the above description, the designation receiver 16 of the information processing device 100A of the present modification does not have a user interface that receives an operation input performed by the listener to designate an attribute(s) (i.e., does not have a touch-panel display screen on which a button-type operation element 161 is displayed), such as that illustrated in the third embodiment.

The fourth embodiment may be modified in substantially the same way. In this case, a storage device 24 of the information processing device 100A stores in advance a plurality of head-related transfer functions F calculated for different attributes. The information processing device 100A transmits to a terminal device 200 a head-related transfer function F that accords with the attribute designation received at the designation receiver 16.

(5) The ear shape analysis device is realized by a control device 22 (such as a CPU) working in cooperation with a program, as set out in the embodiments described above. Specifically, the program for ear shape analysis causes a computer to realize a sample ear analyzer 44, an averaging calculator 46, and an ear shape identifier 48, and the sample ear analyzer 44 generates, for each of N sample ears, ear shape data V(n) that represents a difference between a point group $P_S(n)$ representative of a three-dimensional shape of a sample ear and a point group $P_R$ representative of a three-dimensional shape of a reference ear; the averaging calculator 46 calculates averaged shape data $V_A$ by averaging the N ear shape data sets V(1) to V(N) generated by the sample ear analyzer 44; and the ear shape identifier 48 identifies an average ear shape $Z_A$ of the N sample ears by translating coordinates of the respective points $p_R$ of the point group $P_R$ representing the three-dimensional shape of the reference ear, by using the averaged shape data $V_A$.

The programs pertaining to the embodiments illustrated above may be provided by being stored in a computer-readable recording medium for installation in a computer. For instance, the storage medium may be a non-transitory storage medium, a preferable example of which is an optical storage medium, such as a CD-ROM (optical disc), and may also include a freely-selected form of well-known storage media, such as a semiconductor storage medium and a magnetic storage medium. The programs illustrated above may be provided by being distributed via a communication network for installation in a computer. The present invention may be expressed as an operation method of an ear shape analysis device (ear shape analysis method).

The following modes of the present invention may be derived from the above embodiments and modifications.

An ear shape analysis device according to one aspect of the present invention includes: a sample ear analyzer configured to generate a plurality of ear shape data sets for a plurality of sample ears, each set representing a difference between a point group representative of a three-dimensional shape of a reference ear and a point group representative of a three-dimensional shape of a corresponding one of the plurality of sample ears; an averaging calculator configured to generate averaged shape data by averaging the plurality of ear shape data sets generated by the sample ear analyzer for the plurality of sample ears; and an ear shape identifier configured to identify an average ear shape of the plurality of sample ears by translating coordinates of respective points of the point group representing the three-dimensional shape of the reference ear, by using the averaged shape data.

According to the aspect described above, an ear shape data set that represents a difference between a point group of a sample ear and a point group of a reference ear is generated for each of a plurality of sample ears, and as a result of coordinates of respective points of the point group of the reference ear being translated using averaged shape data obtained by averaging ear shape data sets for the plurality of sample ears, an average ear shape that comprehensively reflects shape tendencies of the sample ears can be identified. Accordingly, by using the average ear shape identified by the ear shape identifier, a head-related transfer function can be generated, use of which enables a large number of listeners to perceive a proper location of a sound image.

The ear shape analysis device according to a preferred mode of the present invention further includes a function calculator configured to calculate a head-related transfer function corresponding to the average ear shape identified by the ear shape identifier. In the mode described above, a head-related transfer function corresponding to the average ear shape identified by the ear shape identifier is calculated. According to the present invention, as described above, a head-related transfer function can be generated, use of which enables a large number of listeners to perceive a proper location of a sound image.

According to a preferred mode of the present invention, the sample ear analyzer generates the plurality of ear shape data sets for the plurality of sample ears, each of the ear shape data sets including a plurality of translation vectors corresponding to respective points of a first group that is a part of the point group of the reference ear; and the averaging calculator, by averaging the plurality of ear shape data sets, generates the averaged shape data including a plurality of translation vectors corresponding to the respective points of the first group. The ear shape identifier identifies the average ear shape by generating translation vectors corresponding to respective points constituting a second group other than the first group within the point group of the reference ear by interpolation of the plurality of translation vectors included in the averaged shape data, and by translating coordinates of the respective points of the first group using the translation vectors of the averaged shape data and translating coordinates of the respective points of the second group using the translation vectors generated by the interpolation. In the mode described above, translation vectors corresponding to respective points of a second group of the point group of the reference ear are generated by interpolation of the plurality of translation vectors included in the averaged shape data. Accordingly there is no need for the sample ear analyzer to generate translation vectors for the entire point group of the reference ear. As a result, a processing load is reduced when the sample ear analyzer generates ear shape data.

The ear shape analysis device according to a preferred mode of the present invention further includes a designation receiver configured to receive designation of at least one of a plurality of attributes, and the sample ear analyzer generates the ear shape data set for each of sample ears, from among the plurality of the sample ears, that have the attribute designated at the designation receiver. In the mode described above, ear shape data sets are generated with regard to sample ears having a designated attribute(s), and therefore, when the listener designates a desired attribute, an average ear shape of the sample ears having the desired attribute(s) can be identified. A head-related transfer function that is more suitable for the attribute of the listener can be generated when compared to a configuration in which no attribute is taken into consideration. Accordingly, it is more likely that the listener will perceive a location of a sound image more properly. The attributes may include a variety of freely-selected attributes, examples of which may relate to gender, age, physique, race, and the like for a person for whom a three-dimensional shape of a sample ear is measured. The attributes may also include categories (types) or the like into which ear shapes are grouped according to their general characteristics.

The present invention may be understood as a method for operation of the ear shape analysis device (ear shape analysis method) according to the different aspects described above. Specifically, an ear shape analysis method according to another aspect of the present invention includes: generating a plurality of ear shape data sets for a plurality of sample ears, each set representing a difference between a point group representative of a three-dimensional shape of a reference ear and a point group representative of a three-dimensional shape of a corresponding one of the plurality of sample ears; generating averaged shape data by averaging the plurality of ear shape data sets generated for the plurality of sample ears; and identifying an average ear shape of the plurality of sample ears, by translating coordinates of respective points of the point group representing the three-dimensional shape of the reference ear, by using the averaged shape data.

An information processing device according to yet another aspect of the present invention includes: an ear shape analyzer configured to calculate a plurality of head-related transfer functions that each reflect shapes of a plurality of sample ears having a corresponding one of a plurality of attributes, where one each of the calculated head-related transfer functions corresponds to one each of the plurality of attributes, and a designation receiver configured to receive designation of at least one of the plurality of head-related transfer functions calculated by the ear shape analyzer. Furthermore, the present invention may be understood as a method for operation of the above information processing device (an information processing method). Specifically, an information processing method according to still yet another aspect of the present invention includes: calculating a plurality of head-related transfer functions that each reflect shapes of a plurality of sample ears having a corresponding one of a plurality of attributes, where one each of the calculated head-related transfer functions corresponds to one each of the plurality of attributes; and receiving designation of at least one of the plurality of calculated head-related transfer functions. According to the aspect described above, since one of the head-related transfer functions calculated for each attribute can be designated, when the listener designates a desired head-related transfer function (i.e., a head-related transfer function corresponding to a desired attribute), the listener is able to perceive a location of a sound image more properly, as compared to a configuration in which no such attribute is taken into consideration.

DESCRIPTION OF REFERENCE SIGNS

100: audio processing device
12: signal supply device
14: sound output device
16: designation receiver
22: control device
24: storage device
31: control device
32: touch panel
42: point group identifier
44: sample ear analyzer
46: averaging calculator
48: ear shape identifier
62: function calculator
50: audio processor
51: adjustment processor
52: sound field controller
53: acoustic characteristic imparter
54R, 54L: convolution calculators
56: reverberation generator
58: signal adder
100A: information processing device
200: terminal device
300: communication network
311: designation transmitter

What is claimed is:

1. An ear shape analysis device comprising:

a sample ear analyzer configured to generate a plurality of ear shape data sets for a plurality of sample ears, each set representing a difference between a point group representative of a three-dimensional shape of a reference ear and a point group representative of a three-dimensional shape of a corresponding one of the plurality of sample ears;

an averaging calculator configured to generate averaged shape data by averaging the plurality of ear shape data sets generated by the sample ear analyzer for the plurality of sample ears; and an ear shape identifier configured to identify an average ear shape of the plurality of sample ears by translating coordinates of respective points of the point group representing the three-dimensional shape of the reference ear, by using the averaged shape data;

wherein the sample ear analyzer generates the plurality of ear shape data sets for the plurality of sample ears, where each of the ear shape data sets includes a plurality of translation vectors corresponding to respective points of a first group that is a part of the point group of the reference ear.

2. The ear shape analysis device according to claim 1, wherein the averaging calculator, by averaging the plurality of ear shape data sets, generates the averaged shape data including a plurality of translation vectors corresponding to the respective points of the first group, and the ear shape identifier identifies the average ear shape, by generating translation vectors corresponding to respective points constituting a second group other than the first group within the point group of the reference ear by interpolation of the plurality of translation vectors included in the averaged shape data, and by translating coordinates of the respective points of the first group using the translation vectors of the averaged shape data and translating coordinates of the respective points of the second group using the translation vectors generated by the interpolation.

3. The ear shape analysis device according to claim 1, further comprising a designation receiver configured to receive designation of one of a plurality of attributes, wherein the sample ear analyzer generates the ear shape data set for each of sample ears, from among the plurality of the sample ears, that have the attribute designated at the designation receiver.

4. The ear shape analysis device according to claim 1, further comprising:

a function calculator configured to calculate a head-related transfer function corresponding to the average ear shape identified by the ear shape identifier.

5. The ear shape analysis device according to claim 4, wherein the head-related transfer function calculated by the function calculator is transmitted to a terminal device.

6. The ear shape analysis device according to claim 1, further comprising:

a function calculator configured to calculate a head-related transfer function corresponding to the average ear shape identified by the ear shape identifier, wherein the sample ear analyzer generates, for each of a plurality of attributes, a plurality of ear shape data sets for sample ears that have each attribute from among the plurality of sample ears, the function calculator calculates head-related transfer functions for the plurality of attribute, based on the plurality of ear shape data sets by generated by the sample ear analyzer, the ear shape analysis device further comprising:

a designation receiver configured to receive designation of one of the head-related transfer functions calculated by the function calculator for the respective attributes.

7. The ear shape analysis device according to claim 6, wherein the designation receiver receives the designation of the attribute from a terminal device, and from among the head-related transfer functions calculated by the function calculator, a head-related transfer function that corresponds to the designated attribute is transmitted to the terminal device.

8. An ear shape analysis method, comprising:

generating a plurality of ear shape data sets for a plurality of sample ears, each set representing a difference between a point group representative of a three-dimensional shape of a reference ear and a point group representative of a three-dimensional shape of a corresponding one of the plurality of sample ears;

generating averaged shape data by averaging the plurality of ear shape data sets generated for the plurality of sample ears; and identifying an average ear shape of the plurality of sample ears, by translating coordinates of respective points of the point group representing the three-dimensional shape of the reference ear, by using the averaged shape data;

wherein each of the generated ear shape data sets includes a plurality of translation vectors corresponding to respective points of a first group that is a part of the point group of the reference ear.

9. The ear shape analysis method according to claim 8, wherein the generated averaged shape data includes a plurality of translation vectors corresponding to the respective points of the first group, and the average ear shape is identified by generating translation vectors corresponding to respective points constituting a second group other than the first group within the point group of the reference ear by interpolation of the plurality of translation vectors included in the averaged shape data, and by translating coordinates of the respective points of the first group using the translation vectors of the averaged shape data and translating coordinates of the respective points of the second group using the translation vectors generated by the interpolation.

10. The ear shape analysis method according to claim 8, further comprising receiving designation of one of a plurality of attributes, wherein generating the plurality of ear shape data sets includes generating an ear shape data set for each of sample ears, from among the plurality of the sample ears, that have the designated attribute.

11. The ear shape analysis method according to claim 8, further comprising:

calculating a head-related transfer function corresponding to the identified average ear shape.

12. The ear shape analysis method according to claim 11, further comprising:

transmitting the calculated head-related transfer function to a terminal device.

13. The ear shape analysis method according to claim 8, further comprising:

calculating a head-related transfer function corresponding to the identified average ear shape, wherein generating the plurality of ear shape data sets includes generating, for each of a plurality of attributes, a plurality of ear shape data sets for sample ears that have each attribute from among the plurality of sample ears, calculating the head-related transfer function includes calculating head-related transfer functions, where each of the head-related transfer functions is calculated for each attribute, based on the plurality of ear shape data sets for the sample ears that have each attribute, the method further comprising:

receiving designation of one of the head-related transfer functions calculated for the respective attributes.

14. The ear shape analysis method according to claim 13, wherein the designation of one of a plurality of attributes is received from a terminal device, and from among the calculated head-related transfer functions, a head-related transfer function that corresponds to the designated attribute is transmitted to the terminal device.

* * * * *